US008191327B2

(12) United States Patent
Griffiths et al.

(10) Patent No.: US 8,191,327 B2
(45) Date of Patent: Jun. 5, 2012

(54) WALL PANEL SYSTEM WITH HOOK-ON CLIP

(75) Inventors: Robert T. Griffiths, Elk River, MN (US); Wayne M. Wagner, West Saint Paul, MN (US)

(73) Assignee: Firestone Building Products Company, LLC, Indianapolis, IN (US)

( * ) Notice: Subject to any disclaimer, the term of this patent is extended or adjusted under 35 U.S.C. 154(b) by 283 days.

(21) Appl. No.: 12/416,263

(22) Filed: Apr. 1, 2009

(65) Prior Publication Data

US 2009/0241455 A1 Oct. 1, 2009

Related U.S. Application Data

(60) Provisional application No. 61/041,433, filed on Apr. 1, 2008.

(51) Int. Cl.
*E04B 2/30* (2006.01)
*B42F 1/00* (2006.01)

(52) U.S. Cl. ..... 52/506.08; 52/235; 52/512; 52/489.1; 24/457; 24/570

(58) Field of Classification Search ..... 52/235, 52/506.01, 506.06, 506.08, 510, 512, 489.1, 52/FOR. 148, 712; 24/457, 570
See application file for complete search history.

(56) References Cited

U.S. PATENT DOCUMENTS 1,510,497 A * 10/1924 Keller ..... 52/547
2,171,221 A * 8/1939 Maus ..... 52/474
2,251,991 A * 8/1941 Fellner ..... 52/506.08
2,317,015 A * 4/1943 Allen ..... 52/512
2,395,726 A * 2/1946 Del Tufo ..... 52/509
2,715,780 A * 8/1955 Hageman ..... 33/648
2,862,585 A * 12/1958 McChesney ..... 52/474
2,928,143 A * 3/1960 Newton ..... 52/547
3,073,420 A 1/1963 Olsen
3,282,004 A * 11/1966 Morrison ..... 52/269
3,378,969 A * 4/1968 Larger ..... 52/223.7
3,936,986 A * 2/1976 Steel ..... 52/235
4,208,799 A * 6/1980 Frantello ..... 33/647
4,370,841 A * 2/1983 Hayashi ..... 52/464
4,425,714 A * 1/1984 Kelly, Jr. ..... 33/646
4,506,484 A * 3/1985 Bartlett et al. ..... 52/476
4,513,669 A * 4/1985 Steinke ..... 108/107
4,580,385 A 4/1986 Field
4,584,813 A * 4/1986 Hudson ..... 52/742.15
4,597,235 A * 7/1986 Olsen ..... 52/509
4,622,794 A * 11/1986 Geortner ..... 52/396.05
4,698,942 A * 10/1987 Swartz ..... 52/99
4,759,157 A 7/1988 Webb et al.
4,780,995 A 11/1988 Gittins
4,796,403 A 1/1989 Fulton et al.
4,798,033 A 1/1989 Weidl
4,800,689 A 1/1989 Lane
(Continued)

*Primary Examiner* — Robert Canfield
*Assistant Examiner* — Brent W Herring
(74) *Attorney, Agent, or Firm* — Jason A. Houser; Arthur M. Reginelli

(57) ABSTRACT

A wall panel system includes at least one wall panel, each edge of the panel having a flange. At least one flange, and preferably two opposing flanges, have at least one slot therein. Each slot is mated with a clip having a unique shape that allows the clip to be inserted into the slot and secured therein without the use of fasteners and strictly due to its shape. The clip may then be attached to a building surface or intermediary mounting apparatus by a fastener to secure the wall panel thereto.

23 Claims, 7 Drawing Sheets

U.S. PATENT DOCUMENTS 4,829,740 A * 5/1989 Hutchison ..... 52/475.1
4,848,045 A 7/1989 Nichols et al.
4,890,426 A 1/1990 Hickman et al.
4,964,248 A 10/1990 Braine et al.
4,969,250 A 11/1990 Hickman et al.
5,031,367 A 7/1991 Butzen
D319,004 S * 8/1991 Schenker ..... D8/382
5,058,358 A * 10/1991 Stratton ..... 52/702
5,063,718 A * 11/1991 Nonis ..... 52/235
5,212,914 A * 5/1993 Martin et al. ..... 52/235
5,222,341 A 6/1993 Watkins et al.
5,239,791 A 8/1993 Mills, Jr. et al.
5,251,411 A 10/1993 Kelley et al.
5,272,846 A 12/1993 Kelley et al.
5,289,662 A 3/1994 Castle
5,414,965 A 5/1995 Kelley et al.
5,414,971 A * 5/1995 Handte ..... 52/506.06
5,533,313 A * 7/1996 Pike et al. ..... 52/712
5,544,461 A * 8/1996 Sommerstein ..... 52/235
5,564,245 A * 10/1996 Rademacher ..... 52/520
5,622,020 A * 4/1997 Wood ..... 52/546
5,893,247 A 4/1999 Hickman et al.
5,927,023 A 7/1999 Kittilstad
D415,950 S * 11/1999 Anderson ..... D8/354
6,035,598 A * 3/2000 Sukolics et al. ..... 52/506.08
6,076,323 A * 6/2000 Chiu ..... 52/562
6,216,408 B1 4/2001 Davidson
6,330,772 B1 * 12/2001 Mitchell et al. ..... 52/235
6,367,220 B1 * 4/2002 Krause et al. ..... 52/512
6,434,853 B2 8/2002 Pyburn
6,442,904 B1 9/2002 Ortiz
6,578,322 B2 6/2003 Kintop
6,606,828 B1 8/2003 Lin et al.
6,694,694 B2 * 2/2004 Zeeff ..... 52/506.01
6,748,709 B1 * 6/2004 Sherman et al. ..... 52/235
D494,454 S * 8/2004 Klein et al. ..... D8/373
6,786,018 B2 9/2004 Webb et al.
6,845,590 B1 1/2005 Mills, Jr.
6,912,813 B2 7/2005 Grizenko
6,912,814 B1 7/2005 Inzeo
6,945,005 B2 9/2005 Nunley
7,059,086 B2 6/2006 Edvardsen
7,185,443 B2 * 3/2007 Penhale ..... 33/649
7,434,329 B2 * 10/2008 Walda ..... 33/649
7,441,382 B2 * 10/2008 Beck et al. ..... 52/543
7,472,521 B2 * 1/2009 Bilge ..... 52/235
7,621,084 B2 * 11/2009 Bilge ..... 52/235
2004/0074188 A1 * 4/2004 Beck et al. ..... 52/522
2007/0022682 A1 * 2/2007 Morgenegg et al. ..... 52/235
2011/0173921 A1 * 7/2011 Orchard ..... 52/712

* cited by examiner

WALL PANEL SYSTEM WITH HOOK-ON CLIP

This applications gains the benefit of U.S. Provisional Application No. 61/041,433 filed Apr. 1, 2008, which is incorporated herein by reference.

FIELD OF THE INVENTION

One or more embodiments of this invention relate to an architectural wall panel system designed to cover an interior or exterior building surface. More particularly, one or more embodiments of this invention relate to an architectural wall panel system with an attachment system having hook-on clips to connect the wall panels to a mounting rail attached to the building surface, the attachment system allowing for thermal cycling of the architectural wall panel system.

BACKGROUND OF THE INVENTION

Architectural wall panel systems, including both metal and composite wall panel systems, have been used extensively for some time, primarily in the commercial and industrial building markets. In recent years the popularity of composite wall panel systems, in particular, has been increasing steadily. There are a number of factors that may be credited for the wide-spread and increased use of such wall panel systems. One such factor is the high cost to construct commercial and industrial buildings, which tend to be relatively large, from stone or brick. Wood is not a suitable substitute due to the large loads the buildings supporting structure must withstand. Another factor affecting the increased use of metal and composite wall panel systems is the high durability of the systems. Both the metals and composites used to make the panels for wall panel systems are highly resistant to damage from sun, dirt, moisture, fire, and many other environmental elements. Consequently, the metal and composite wall panel systems have a long life, and may require less maintenance than other alternative building materials and systems.

Architectural wall panel systems can generally be placed into one of two categories: face-sealed architectural panel systems or vented rain-screen architectural panel systems. Face-sealed architectural panel systems include those systems that include a sealant in both the horizontal and vertical joints between adjacent wall panels. The sealants make the wall panel system impermeable to air and water, and may include caulking, gaskets, or other sealants with a similar function. Vented rain-screen architectural panel systems are those systems designed to allow permeability through the joints between adjacent wall panels. The permeable joints allow for breathability and rapid pressure equalization within the wall panel system to prevent pressure buildups behind the wall panels.

Architectural wall panel systems have many advantages, as discussed above, however, these systems may also present a number of challenges and disadvantages. One such challenge is the thermal expansion and contraction of the wall panels. The metal and composite materials used most commonly in architectural wall panel systems are subject to natural expansion and contraction due to changes in atmospheric conditions, including heat and humidity. If a means of accommodating this inherent thermal cycling is not provided in the attachment system of the architectural wall panel system then the panels can become warped and cracked, requiring repairing or replacement. Another challenge that may be associated with architectural wall panel systems is directly related to the first issue of thermal cycling, and relates to the effectiveness of sealants used in joints between adjacent wall panels in face-sealed architectural panel systems. Because the joints increase and decrease in size during thermal cycling, sealants often become dislodged and/or cracked and are thereafter ineffective at preventing the infiltration of air and water. As a result, sealants used in face-sealed architectural panel systems have proven disappointingly ineffective.

Another disadvantage associated with many architectural wall panel systems is the complexity of the system, including the number of pieces and parts needed and the extensive time and labor required to install the complex system. In particular, where a form of attachment clips are used to secure the wall panels to the substructure, each clip must typically be fastened to the wall panel and to the substructure, either directly or indirectly. This means that if an extremely high number of fasteners are used, it results in a great deal of time and effort spent in installation of the systems just to secure the clips to the panels prior to attaching the panels to the structure.

A number of different attachment systems have been introduced and employed in an attempt to overcome the challenges and alleviate the disadvantages discussed above. One known attachment system includes a plurality of locking members secured directly to, or formed integrally with, the outer surface of the return flanges of wall panels. The locking members secure the panel to a retaining member, which is itself secured to a surface of a building structure. The locking members are shaped such that they may be forced into a channel, but cannot be removed from that channel, such as angled surfaces with an apex adjacent the retaining member that resemble half of an arrowhead. The system may also optionally provide a drainage channel to carry water and other debris away from the surface of the building structure. While this attachment system allows for more efficient installation of an architectural wall panel system, it suffers from the disadvantage mentioned above relating to thermal cycling of the wall panel system because it does not allow for movement of the wall panels. In addition, the attachment system suffers from a number of new disadvantages, such as not providing adequate attachment strength to withstand some natural weather conditions, and making it extremely difficult to repair or replace installed wall panels as the locking members prevent the panel from being removed from the retaining members.

Other known attachment systems for securing wall panels of an architectural wall panel system to a building surface utilize some form of an insert wedged between the two adjacent flanges of adjacent wall panels, while the flanges are received in a channel. The insert is secured between the two flanges by a fastener, and fits snuggly therebetween to provide a seal against water and air infiltration. The insert may be made of an elastomeric material to allow for thermal expansion and contraction of the wall panels. This system, however, uses a high number of parts, and the thermal cycling of the system is limited by the small amount of movement allowed by the elastomeric insert. Furthermore, the elastomeric insert is subject to wear from the natural elements it will be exposed to, and subject to failure due to these elements and repeated expansion and contraction as a result of the thermal cycling of the wall panel system.

Additional attempts at improved attachment systems have included attachment systems utilizing variously shaped flanges extending along at least one edge of the wall panel to facilitate attachment of the panel to a building surface; attachment systems using rotatable retaining members secured to the mounting surface that rotate between a first (narrow) position designed to allow placement of the wall panels and a second (broad) position extending into slots in the wall panel flange to secure the panel in place, such as, for example, a T-shaped retaining member that rotates about an axis parallel to the wall panel flanges; and attachment systems having vents and filler strips which slide into grooves and are positioned within the gaps between adjacent wall panels to provide a watertight seal while allowing air flow therethrough. None of these attachment systems has proven noticeably advantageous over conventional attachment methods in providing a more efficient, reliable, and practical means of attaching architectural wall panels to the surface of a structure.

There is therefore a need for an improved architectural wall panel system, and specifically an improved attachment system for attaching architectural wall panels, that alleviates one or more of the disadvantages discussed herein.

DETAILED DESCRIPTION OF ILLUSTRATIVE EMBODIMENTS

Figure 1:
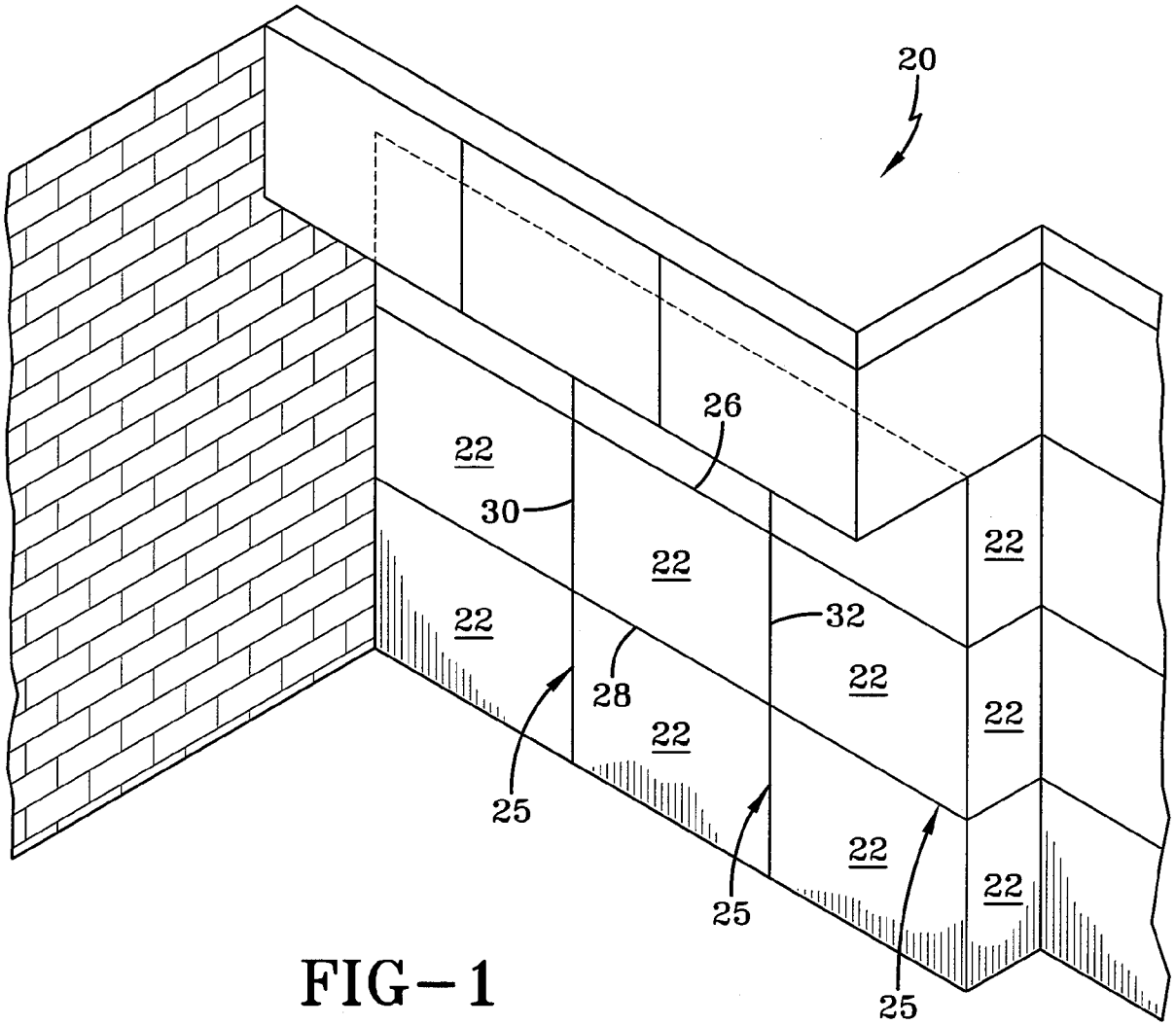
FIG. 1 is perspective view of a wall panel system installed on a building surface according to the concepts of the present invention.

In one or more embodiments of the present invention an architectural wall panel system (hereinafter referred to as wall panel system) is provided, and is generally indicated by the numeral 20 in FIG. 1. With reference to FIG. 2, an exemplary wall panel system 20 is shown as installed on a building surface 24 (FIG. 2). Wall panel system 20 includes a plurality of wall panels 22 positioned adjacent to one another on a surface, such as building surface 24. While reference will be made herein to building surface 24, it should be appreciated that wall panel system 20 may be used on any desired surface, whether interior or exterior, and reference to building surface 24 should not be interpreted as limiting the scope of the invention.

Wall panels 22 may be made of any suitable material that has the strength and wear characteristics to withstand the natural forces and elements that act upon the wall panel system. Such materials will be readily apparent to a person of ordinary skill in the art. In one or more embodiments, wall panels 22 may be made of metal, and in a preferred embodiment wall panels 22 are made of aluminum. In another embodiment, wall panels 22 may be made of a composite material. Wall panels 22, as shown in the figures, have a rectangular shape. However, other shapes may be employed without deviating from the scope of the invention. Wall panels 22 are positioned adjacent to one another with a gap, generally indicated by the numeral 25, therebetween to facilitate installation and thermal cycling, as will be discussed in greater detail below.

Each wall panel 22 has a top edge 26, a bottom edge 28, a left side edge 30, and a right side edge 32. Gaps 25 are formed between the adjacent edges of two panels, such as, for instance, a horizontal gap 25 between top edge 26 of a lower panel and bottom edge 28 of an upper panel positioned immediately above the lower panel. Similarly, vertical gaps 25 are formed between a left side edge 30 and a right side edge 32 of adjacent panels.

Figure 2:
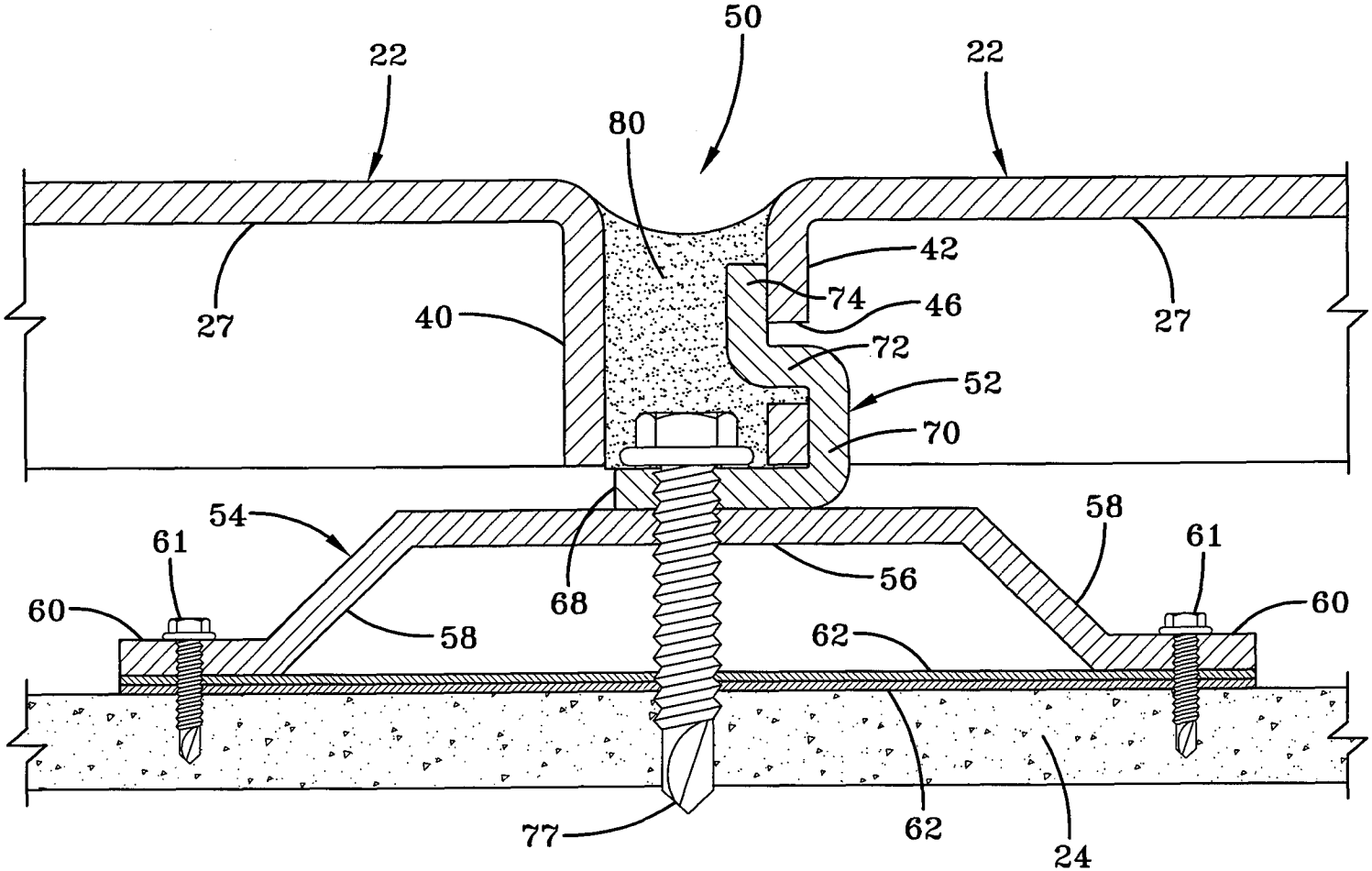
FIG. 2 is a cross section view of a portion of the wall panel system of FIG. 1.

As is apparent from FIG. 1, wall panel system 20 may be adapted to be used to cover inside and outside corners, soffits, copings, window peripheries, and other architectural features that may be present on building surface 24. In one or more embodiments the adaptation of wall panel system 20 to the architectural features of building surface 24 may be accomplished by varying the dimensions of wall panels 22. Thus, in at least one embodiment of the invention, wall panels 22 may be of different shapes and sizes as needed to properly cover building surface 24.

In one or more embodiments wall panel 22 is generally pan shaped having a body portion 27 and side portions, also referred to as side flanges or flanges, extending from the edges of body portion 27. The side flanges of wall panel 22 extend a relatively short distance from body portion 27, as compared with the overall dimensions of wall panel 22. The flanges extend from each edge so that top edge 26, bottom edge 28, left side edge 30, and right side edge 32 each has a flange extending therefrom. FIG. 2 shows a left side flange 40, and right side flange 42 of wall panels 22. In one or more embodiments the flanges may be connected at the corners of body portion 27, and in other embodiments a gap may exist between adjacent flanges at the corners of body portion 27. The flanges each have an inner surface facing the center of body portion 27, and an outer surface facing away from the center of body portion 27.

Body portion 27 may have any desired size, depending upon the desired appearance of wall panel system 20 and the engineering design constraints relating to wind forces and other such factors that may limit the dimensions of wall panel 22 in one or more ways. In one or more embodiments, such as the embodiment shown in the figures with a rectangular shaped wall panel 22, body portion 27 may have a height, or distance between top edge 26 and bottom edge 28, of between approximately 3 inches and 72 inches, in other embodiments between approximately 6 inches and 60 inches, and in still other embodiments between 6 inches and 48 inches. Similarly, body portion 27 may have a width, or distance between left side edge 30 and right side edge 32, of between approximately 3 inches and 180 inches, in other embodiments between approximately 6 inches and 144 inches, and in still other embodiments between 6 inches and 120 inches.

The height and width of wall panel 22 may differ, creating a rectangular shaped body portion 27, or they may be equal, thereby making body portion 27 square in shape. In one or more embodiments wall panel 22 may have a depth of between approximately 0.5 inches and 6 inches, in other embodiments a depth of between 0.5 and 3 inches, and in a preferred embodiment a depth of approximately 0.875 inches. Wall panel 22 may also include one or several of a variety of finishes or textures to provide a desired appearance, as is well known in the art.

The side flanges may also include slots 46 therein. In one or more embodiments slots 46 are included in one pair of opposing flanges of wall panel 22, typically the longer side of wall panel 22. For example, if wall panel 22 is wider than it is tall, then the flanges extending from top edge 26 and bottom edge 28 will include slots therein and left side flange 40 and right side flange 42 will not. Conversely, if wall panel 22 is taller than it is wide, then left side flange 40 and right side flange 42 will include slots therein and the flanges extending from top edge 26 and bottom edge 28 will not. In the case of a substantially square wall panel 22, slots may be provided in either pair of opposed flanges.

Slots 46 may be of various sizes according to the scope of the present invention, and may be spaced at any desired distance from one another, with both the sizing and spacing of slots 46 depending upon the specific constraints of an attachment system 50 used to attach wall panel 22 to building surface 24. In one or more embodiments each wall panel flange having slots 46 includes at least three slots 46 to allow for proper attachment to building surface 24, as will be discussed in greater detail hereinafter. In other embodiments, particularly where wall panels 22 are relatively large in size, more than three slots 46 per flange may be provided.

The attachment system 50 used to secure wall panels 22 to building surface 24 is best shown in FIG. 2. Although a vertical joint is shown, it should be appreciated that wall panels 22 with slots in their horizontal flanges, that are secured to building surface 24 along their horizontal edges are attached in a similar manner, except that the components of the attachment system 50 are reoriented. In one or more embodiments of the attachment system 50, such as that shown in FIGS. 3 and 4, a plurality of clips, generally indicated by the numeral 52, secure wall panel 22 to a mounting rail, generally indicated by the numeral 54, attached to building surface 24. Mounting rails 54 includes a planar surface 56 that is generally parallel to building surface 24, and a pair of legs 58 extending between planar surface 56 and building surface 24. Mounting rails 54 also includes a pair of mounting flanges 60, each mounting flange 60 extending outwardly from an end of a leg 58 opposite planar surface 56.

Mounting rails 54 extend along building surface 24 in a generally vertical orientation. Other mounting rails 54 may be positioned similarly at the vertical joints between adjacent wall panels 22 throughout wall panel system 20. Mounting rails 54 are secured to building surface 24 by a plurality of fasteners 61 through mounting flanges 60. Fasteners 61 may be any conventional fasteners known to those skilled in the art. In a preferred embodiment, fasteners 61 are self-drilling fasteners so that they may be installed through mounting flanges 60 and building surface 24 without the need for pre-drilling holes.

In one or more embodiments, shims 62 are provided between building surface 24 and mounting rail 54, with fasteners 61 be driven therethrough. Shims 62 are used to ensure that wall panels 22 are kept plum, due to the reality that most building surfaces 24 are not plum when finished. While the preferred embodiment shown in the figures and discussed herein includes mounting rails 54 as described above, it should be appreciated that such mounting rails 54 may have a different shape or orientation, and in some cases may not be necessary at all. In cases where mounting rails 54 are used, it is only necessary that the rails be secured to building surface 24 and that they provide a mounting surface for clips 52. For instance, in other embodiments, and as discussed above, identical mounting rails 54 may extend in a generally horizontal orientation beneath the horizontal joints between adjacent wall panels 22, as opposed to the vertical joints, to allow attachment of wall panels 22 to building surface 24. Alternatively, in still other embodiments, wall panel 22 may be attached to building surface 24 through clips 52 without the use of any intermediary mounting rails 54, and instead secured to building surface 24 directly by a fastener through clip 52.

Figure 4:
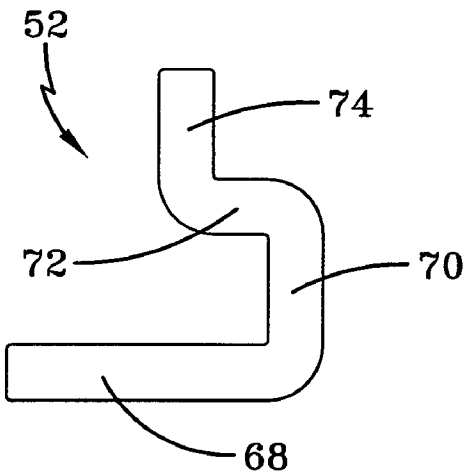
FIG. 4 is a side elevational view of the clip of FIG. 3.
Figure 3:
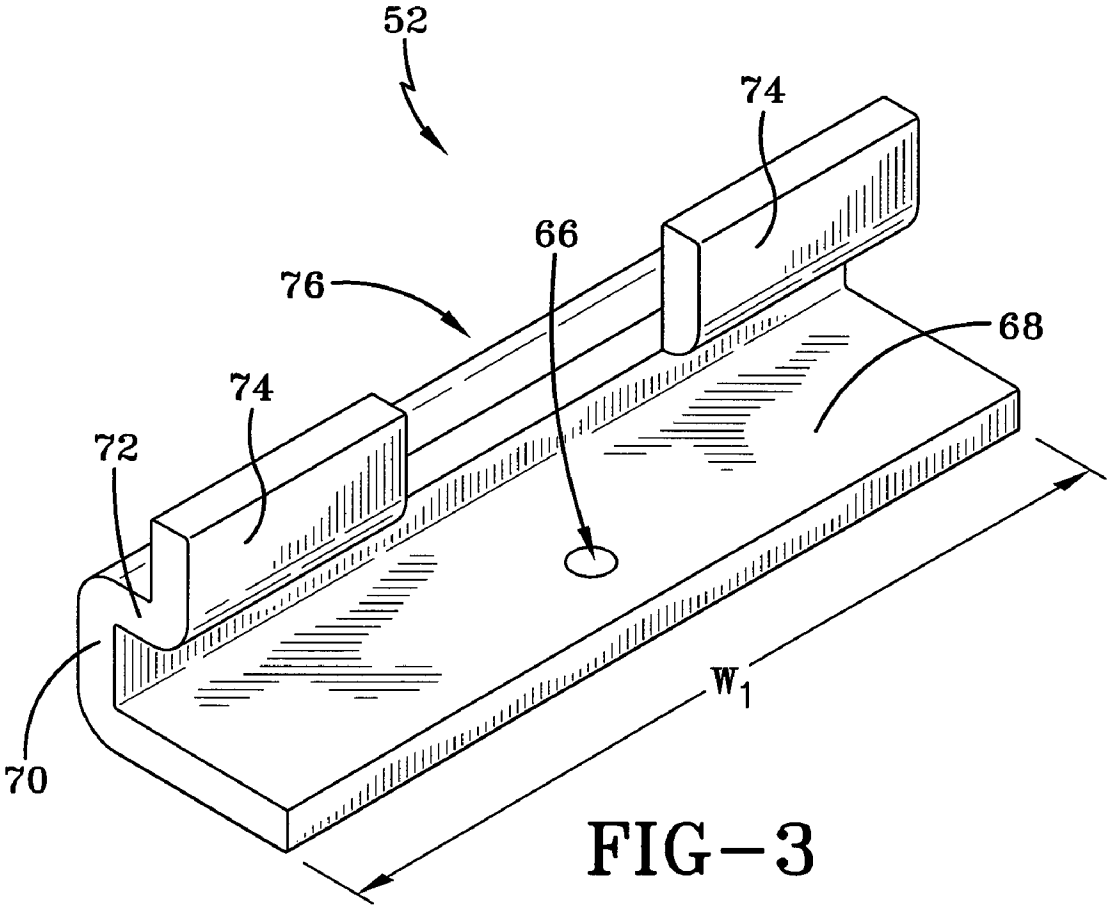
FIG. 3 is a perspective view of a clip according to the concepts of the present invention.
Figure 5:
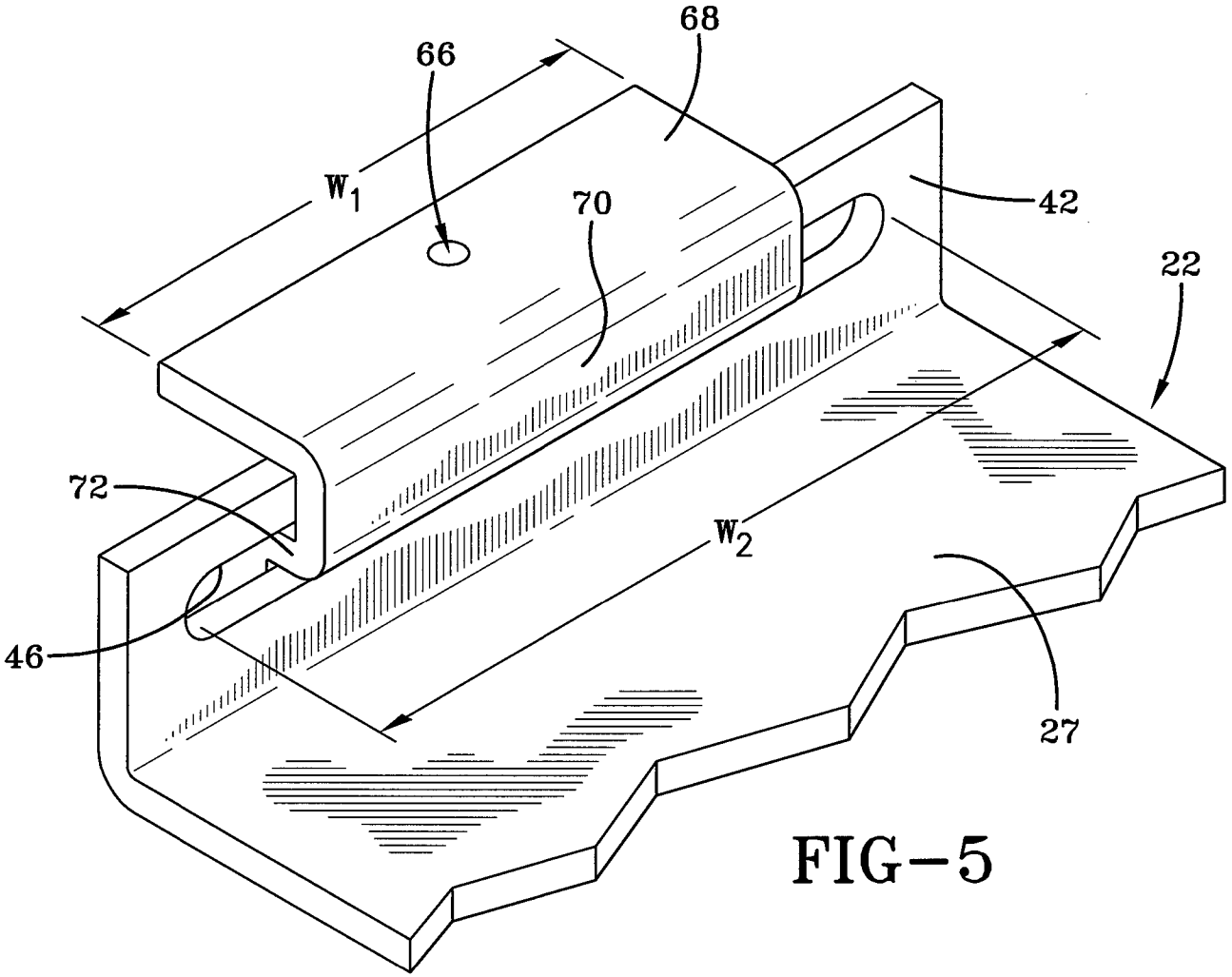
FIG. 5 is a perspective view of a clip inserted into a slot in a wall panel flange according to the concepts of the present invention.

A plurality of clips 52 are provided to secure wall panel 22 to mounting rail 54, or, alternatively, directly to building surface 24. Clips 52 are designed to be secured to panels 22 by hooking into slots 46, as opposed to the conventional method of using fasteners, such as rivets, to secure clips 52 to wall panels 22. Each clip 52, as best seen in FIGS. 3-5, has a fastening plate 68 which may have any desired width $w_1$, but may, for example, be from within the range of approximately 0.5 inches to 1.5 inches. A first extension 70 extends from one end of fastening plate 68 and is substantially perpendicular thereto. A second extension 72 extends from the end of first extension 70 opposite fastening plate 68 and is substantially parallel to fastening plate 68. Thus, fastening plate 68, first extension 70, and second extension 72 form a generally U-shaped cross-sectional portion of clip 52. Second extension 72 is only a fraction of the length of fastening plate 68 such that fastening plate 68 extends farther in a direction away from first extension 70 than does second extension 72. In one or more embodiments, second extension 72 is approximately half the length of fastening plate 68. In one or more embodiments, second extension 72 has a length that at least greater than the thickness of the flanges of wall panel 22. A flange-engaging portion 74 extends from the end of second extension 72 opposite first extension 70, the flange-engaging portion 74 preferably being substantially perpendicular to fastening plate 68, and preferably substantially parallel to first extension 70. Flange-engaging portion 74 may include a notch 76 therein, which may be centered, to facilitate insertion of fasteners through fastening plate 68, as will be discussed in greater detail below.

Figure 6A:
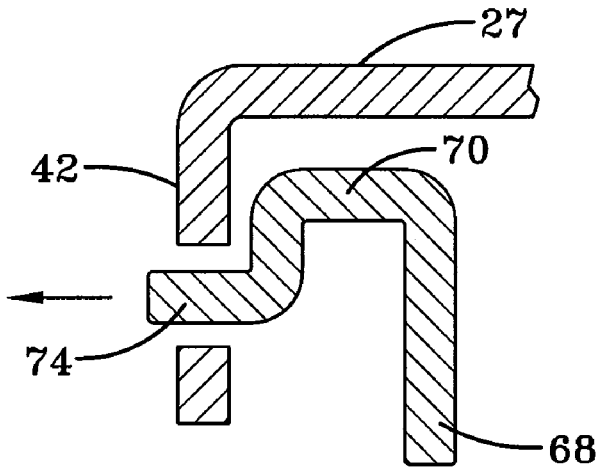
FIG. 6A is a cross sectional view of a clip being inserted into a slot in the flange of a wall panel according to the concepts of the present invention.
Figure 6B:
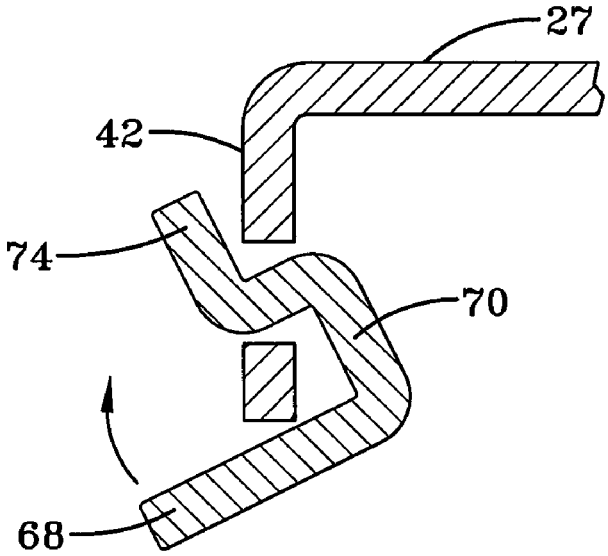
FIG. 6B is sectional view, as in FIG. 6A, where the clip is being rotated into position.
Figure 6C:
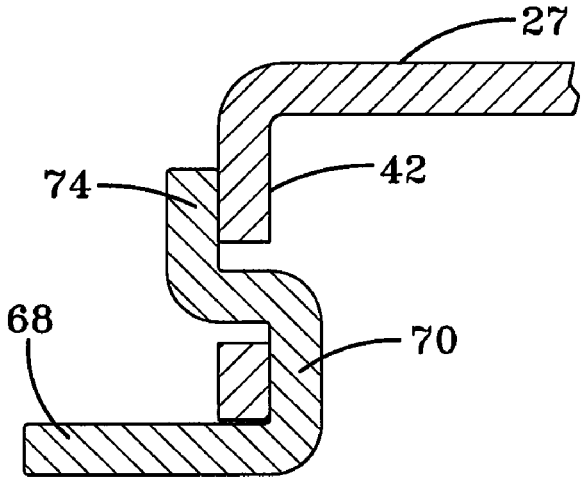
FIG. 6C is a sectional view, as in FIG. 6B, where the clip is fully rotated and in its final position and secured in the slot in the wall panel flange.

The shape of clip 52 allows it to be inserted into a slot 46 in the flange of a wall panel 22 by rotating it slightly as it is inserted. Clip 52 is first positioned with first extension 70 adjacent and parallel to body portion 27 of wall panel 22, with flange-engaging portion 74 protruding into slot 46 (FIG. 6A). From this position, clip 52 can be rotated (clockwise as seen in FIG. 2 and FIGS. 6*a*-6*c*) as it is inserted farther into slot 46 (FIG. 6B). The rotation of clip 52 proceeds until first extension 70 is substantially parallel with the flange 42 of wall panel 22, and flange-engaging portion 76 is positioned proximate to an outside surface of the wall panel's flange 42 (FIG. 6C).

Clip 52, when in a fully installed wall panel system, attaches wall panel 22 to mounting rail 54 without the use of fasteners to attach clip 52 to wall panel 22, thereby allowing thermal cycling. As can also be seen from the drawings, (FIGS. 2 and 5), fastening plate 68 protrudes outwardly from wall panel 22 when clip 52 is fully engaged. A fastener 77 may then be inserted through a hole 66 in fastening plate 68 and into mounting rail 54 to secure clip 52, and consequently wall panel 22, to building surface 24. If necessary, notch 76 in flange-engaging portion 74 may allow a nut driver to fit within gap 25 between adjacent wall panels 22 to secure fastener 77 to mounting rail 54.

In one or more embodiments slots 46 in the wall panel flanges may be made larger than clips 52 to allow for thermal cycling of wall panel system 20. For example, in certain embodiments, clips 52 may have a width $w_1$, of approximately 2.0 inches, and slots 46 may have a corresponding width $w_2$ of approximately 3.0 inches. The additional width provided by slots 46, along with the design of clips 52, which do not require fasteners for attachment to wall panels 22, allows wall panel system 20 to expand and contract as dictated by temperatures and other natural conditions without suffering from deformation.

Figure 9:
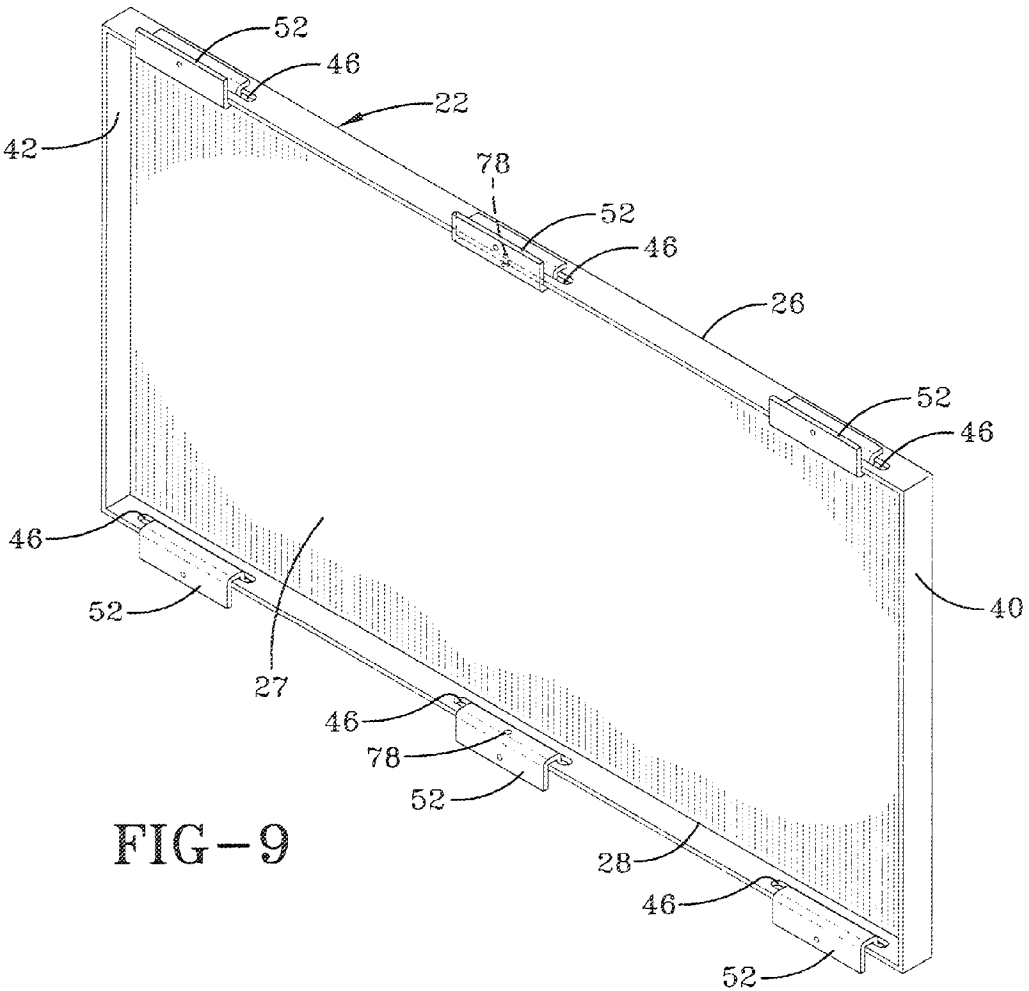
FIG. 9 is a perspective view of a wall panel having clips secured thereto according to the concepts of the present invention.

In one or more embodiments, one clip 52 of a plurality of clips 52 on each flange attaching wall panel 22 to mounting rail 54 may be secured to the flange of wall panel 22 by a fastener 78, as shown in FIG. 9, to maintain the proper positioning of wall panel 22 in wall panel system 20. The attachment of a single clip 52 on each flange of a wall panel 22 having slots 46 will not prevent thermal cycling, as the other clips 52 will remain free to slide in either direction within slots 46, but the single attachment point will maintain proper spacing and placement of wall panels 22 in relation to other wall panels in wall panel system 20. In at least one embodiment a fastener 78 is provided to attach a center clip 52 on each flange having clips 52, so that expansion and contraction may occur in either direction away from the attached center clip 52. In one or more embodiments, clips 52 may be staggered along the joint between adjacent wall panels. This may be necessary where clips 52 from adjacent panels would otherwise extend into the same area within gaps 25. In order to allow for such staggered attachment, opposing flanges of wall panels 22 may be provided with slots 46 in complimentary locations.

With reference back to FIG. 2, it can be seen that clips 52 secure wall panels 22 to mounting rail 54. Clips 52 are attached to mounting rails 54, or alternatively directly to building surface 24, by a fastener 77 extending through fastening plate 68. Fastener 77 is preferably a self-tapping screw so that no pre-drilling is required during installation of wall panel system 20. Once wall panels 22 have been secured to building surface 24 by clips 52 and mounting rails 54, a sealant 80 (FIG. 2) may be provided in gaps 25 between adjacent panels 22 to prevent air and water infiltration through wall panel system 20. In one or more embodiments sealant 80 may be in the form of silicone.

Figure 7:
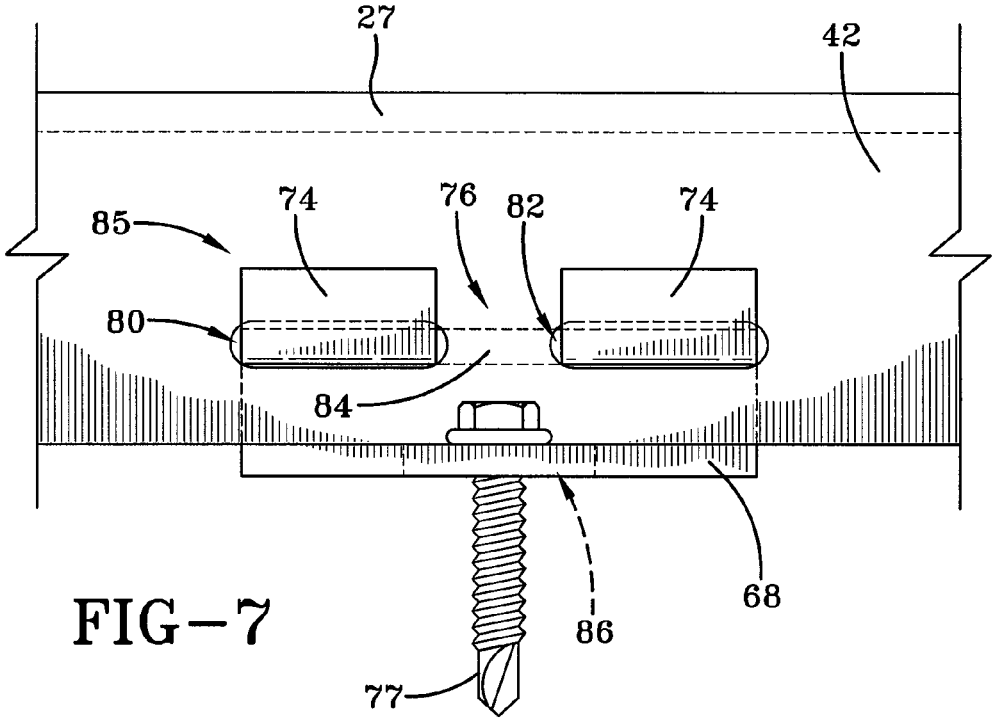
FIG. 7 is an end view of an alternative wall panel attachment system wherein a pair of slots are provided in the wall panel flange for each clip.
Figure 8:
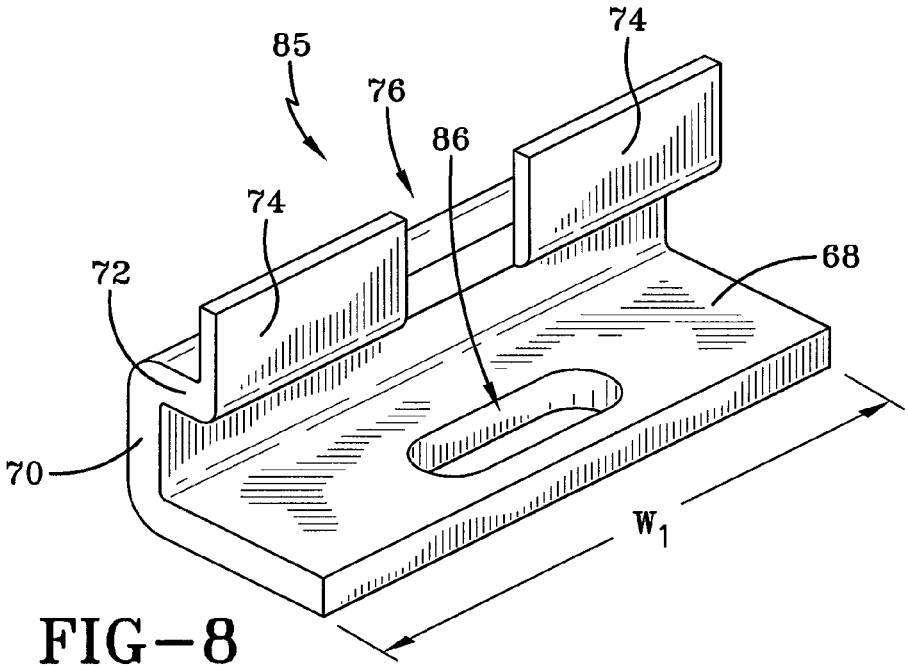
FIG. 8 is a perspective view of an alternative clip wherein a slot is provided to receive an anchoring fastener.

In an alternative embodiment of the invention, as shown in FIG. 7, a pair of slots 80 and 82 is provided in flange 42. Each slot 80 and 82 receives a flange engaging portion 74 of clip 85. Clip 85 is identical to clip 52, as discussed above, in all respects except for those specifically discussed below. Thus, like parts are identified by like numerals. In one or more embodiments, each slot 80 and 82 may be approximately the same width, but slightly wider than the flange engaging portion 74 received therein so as to prevent any significant lateral movement of clip 85 relative to flange 42. Slots 80 and 82 are separated by a dividing portion 84 of flange 42 that is received in slot 76 of clip 52. The dividing portion 84 between slots 80 and 82 helps to strengthen and reinforce flange 42 in the area of attachment of clips 52. This alternative embodiment of the invention is particularly useful with composite wall panels, which are weaker than wall panels made of other materials such as, for example, metal.

In one or more embodiments clips 85 may be secured to wall panel 22 in the same manner as discussed herein with respect to FIGS. 6A-6C. Thus, flange engaging portions 74 are inserted into the corresponding slots 80 and 82, and clip 85 is then rotated until the flange engaging portions 74 contact and engage flange 42. In one or more embodiments fastening plate 68 includes a slot 86 in place of hole 66 of clip 52 discussed above. Fastener 77 is received through slot 86 and secures clip 85 to mounting bracket 54. Slot 86 is wider than the diameter of fastener 77, thereby allowing for lateral movement of clip 85 relative to mounting bracket 54. In this way, clips 85 allow for thermal expansion and contraction of wall panels 22 despite flange engaging portions 74 being unable to slide laterally within slots 80 and 82.

Various modifications and alterations that do not depart from the scope and spirit of this invention will become apparent to those skilled in the art. This invention is not to be unduly limited to the illustrative embodiments set forth herein.

What is claimed is:

1. A clip for securing a wall panel to a building surface, the wall panel having flanges and slots in the flanges for receiving the clips, the clips comprising:

a fastening plate having a first edge and a second edge;

a first extension extending from said first edge substantially perpendicular to said fastening plate;

a second extension extending from an end of and substantially perpendicular to the first extension toward said second edge of said fastening plate, said second extension extending a distance less than the distance between said first and second edges of said fastening plate; and a flange-engaging portion extending from the end of and substantially perpendicular to said second extension, and including a notch therein;

wherein said clip terminates at the second edge of the fastening plate.

2. The clip of claim 1, wherein said fastening plate includes an aperture adapted to receive a fastener therethrough.

3. An attachment system for a wall panel system having wall panels, the attachment system comprising:

(a) a plurality of slots in flanges of said wall panels;

(b) a plurality of clips mated with said slots, said clips having a fastening plate with a first edge and a second edge, a first extension extending from said first edge substantially perpendicular to said fastening plate, a second extension extending from an end of and substantially perpendicular to said first extension toward said second edge of said fastening plate, and a flange-engaging portion extending from the end of and substantially perpendicular to said second extension, said flange engaging portion contacting an exterior surface of said flange.

4. The attachment system of claim 3, where each said flange-engaging portion of said clip includes a notch therein, said notch defining a first flange engaging portion on a first side of said slot and a second flange engaging portion on a second side of said slot.

5. The attachment system of claim 3, further comprising a plurality of mounting rails attached to a building surface proximate said flanges in said wall panels, where said clips are secured to said mounting rails by a fastener.

6. A wall panel system for attachment to a building surface, the wall panel system comprising (a) a wall panel, having two opposing flanges extending from opposing edges of the panel;

(b) at least one slot in each said flanges; and (c) a clip mated with each of said slots, said clips having a fastening plate with a first edge and a second edge, a first extension extending from said first edge substantially perpendicular to said fastening plate, a second extension extending from an end of and substantially perpendicular to said first extension toward said second edge of said fastening plate, and a flange-engaging portion extending from the end of and substantially perpendicular to said second extension;

where said wall panel is attached to a surface by said clip mated with said slot in said flange, and where said clip is secured within said slot by virtue of its shape.

7. The wall panel system of claim 6, wherein flanges extend from four edges of the wall panel.

8. The wall panel system of claim 6, wherein said fastening plate includes an aperture therethrough.

9. The wall panel system of claim 8, further comprising a mounting rail attached to the building surface, wherein said clip is secured to said mounting rail by a fastener received in said aperture of said fastening plate.

10. The wall panel system of claim 8, wherein said clips are directly secured to the building surface by a fastener received in said aperture of said fastening plate.

11. The wall panel system of claim 6, wherein said clips are mated with said slots in said flange without the use of a fastener.

12. The wall panel system of claim 6, wherein said slots are wider than said clips to allow for thermal expansion of said wall panel.

13. The wall panel system of claim 12, wherein said wall panel includes at least three slots in each of said flanges, and six clips, each of said clips being mated with one of said slots for securing said wall panel.

14. The wall panel system of claim 13, wherein one of said clips on each of said flanges is secured to said flange with a fastener, and wherein the other of said clips are not secured by a fastener and are able to slide within said slots.

15. The wall panel system of claim 6, wherein a plurality of said wall panels are positioned adjacent to one another and have a gap therebetween.

16. The wall panel system of claim 15, wherein a sealant is provided in said gap between adjacent wall panels.

17. The wall panel system of claim 6, further comprising shims positioned between the building surface and said mounting rail.

18. A wall panel system for attachment to a building surface, the wall panel system comprising (a) a wall panel, having two opposing flanges extending from opposing edges of the panel;

(b) at least one pair of slots in each of said flanges; and (c) a clip mated with each of said slots, said clips having a fastening plate with a first edge and a second edge, a first extension extending from said first edge substantially perpendicular to said fastening plate, a second extension extending from an end of and substantially perpendicular to said first extension toward said second edge of said fastening plate, and a flange-engaging portion extending from the end of and substantially perpendicular to said second extension;

wherein said flange engaging portion includes a notch therein, said notch defining a first flange engaging portion and a second flange engaging portion, said first and second flange engaging portions being received in said pair of slots in said flange, said clip being secured within said slot by virtue of its shape.

19. The wall panel system of claim 18, wherein said slots in said flange have a width approximately equal to but slightly wider than said first flange engaging portion and said second flange engaging portion to substantially prevent lateral movement of said clip relative to said wall panel.

20. The wall panel system of claim 19, wherein said fastening plate of said clip includes a slot therethrough.

21. The wall panel system of claim 20, further comprising a fastener received in said slot in said fastening plate, said fastener securing said clip to a surface.

22. The wall panel system of claim 21, wherein said slot is wider than the diameter of said fastener allowing for lateral movement of said clip relative to said surface.

23. The wall panel system of claim 18, further comprising a mounting bracket secured to the building surface, said clips being secured to said mounting bracket.

* * * * *